US008136808B2

(12) United States Patent
Kimura et al.

(10) Patent No.: US 8,136,808 B2
(45) Date of Patent: Mar. 20, 2012

(54) PAPER FEEDING DEVICE AND IMAGE FORMING APPARATUS WITH CURL CORRECTION

(75) Inventors: Masaharu Kimura, Osaka (JP); Masatsugu Ohishi, Hyogo (JP); Masahiko Fujita, Nara (JP); Tadasu Taniguchi, Nara (JP); Yasuaki Fukada, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 12/401,780

(22) Filed: Mar. 11, 2009

(65) Prior Publication Data

US 2009/0230608 A1 Sep. 17, 2009

(30) Foreign Application Priority Data

Mar. 14, 2008 (JP) ..... 2008-066194

(51) Int. Cl.
*B65H 1/00* (2006.01)

(52) U.S. Cl. ..... 271/161; 271/127

(58) Field of Classification Search ..... 271/161, 271/127, 209, 23, 148, 165–166
See application file for complete search history.

(56) References Cited

U.S. PATENT DOCUMENTS

| | | | | |
|---|---|---|---|---|
| 3,761,079 | A * | 9/1973 | Azure, Jr. | 271/116 |
| 4,232,860 | A * | 11/1980 | Brown | 271/119 |
| 4,619,450 | A * | 10/1986 | Anderson et al. | 271/35 |
| 4,653,742 | A * | 3/1987 | Sasaki et al. | 271/114 |
| 6,139,008 | A * | 10/2000 | Margiotta | 271/148 |
| 6,783,126 | B2 * | 8/2004 | Amamoto | 271/152 |
| 7,464,925 | B2 * | 12/2008 | Dobbertin et al. | 271/148 |
| 7,464,926 | B2 * | 12/2008 | Moore et al. | 271/148 |
| 7,806,402 | B2 * | 10/2010 | Sato et al. | 271/165 |

FOREIGN PATENT DOCUMENTS

| | | |
|---|---|---|
| JP | 02-175521 | 7/1990 |
| JP | 05-024631 | 3/1993 |
| JP | 06-087543 | 3/1994 |
| JP | 06-092481 | 4/1994 |
| JP | 07-187452 | 7/1995 |
| JP | 11-059975 | 5/1999 |
| JP | 11-189343 | 7/1999 |
| JP | 2002-104677 | 4/2002 |
| JP | 2002-274666 | 9/2002 |
| JP | 2004-277114 | 10/2004 |
| JP | 2005-255269 | 9/2005 |

* cited by examiner

*Primary Examiner* — Jeremy R Severson
(74) *Attorney, Agent, or Firm* — Renner, Otto, Boisselle & Sklar, LLP

(57) ABSTRACT

A paper feeding device 200 provided in an image forming apparatus 1A according to one embodiment of the present invention is provided with a loading member 201 in which sheets P can be stacked and a central bending section 210 configured to upwardly raise a sheet transport direction X central area P2 of the sheet P for sheets P stacked in the loading member 201.

8 Claims, 9 Drawing Sheets

PAPER FEEDING DEVICE AND IMAGE FORMING APPARATUS WITH CURL CORRECTION

CROSS-REFERENCE TO RELATED APPLICATION

This application claims priority on Patent Application No. 2008-066194 filed in Japan on Mar. 14, 2008, the entire contents of which are hereby incorporated by reference.

BACKGROUND OF THE INVENTION

The present invention relates to paper feeding devices that can be applied in apparatuses such as image forming apparatuses that carry out predetermined processing on sheets such as papers, and particularly relates to paper feeding devices and image forming apparatuses provided with these in which sheets from a loading member in which sheets can be loaded and stacked are supplied to outside the loading member.

Generally a sheet housing portion, such as a paper feeding cassette or a paper feeding tray accommodating a plurality of sheets, is installed in a paper feeding portion in apparatuses such as image forming apparatuses that carry out predetermined processing on sheets. The paper feeding device is provided in a paper feeding portion, and this paper feeding device is provided with a paper feeding mechanism that supplies the sheet positioned at an uppermost portion of the sheets housed in the sheet housing portion in order sheet by sheet toward a transport path.

Ordinarily, a loading member in which sheets can be loaded is provided in the paper feeding device to facilitate the feeding of the sheets by the paper feeding mechanism.

In this regard, when sheets such as papers are left exposed to open air (for example, when loaded in the sheet housing portion), the sheets sometimes curl (for example, they may curl such that end portions gradually become higher than central portions in a sheet transport direction) due to the effect of humidity or temperature or the like. When this happens, the following problems may occur.

In ordinary ambient environment conditions (for example, a low temperature and low humidity (more specifically, 10° C., 20% RH) or a high temperature and high humidity (more specifically, 30° C., 85% RH)), sheets such as papers tend to curl easily. In particular, in cases where curling has occurred in sheets having a certain thickness having a basis weight (grammage) of 100 g/m$^2$ or greater such as firm cardboards and glossy papers or the like, problems occur of sheet blockages (hereinafter referred to as jamming).

Hereinafter, description is given regarding problems caused by sheet curling using as an example a case in which a rotating board is used as the loading member.

In this case, the rotating board is rotatable around an axis along a horizontal direction orthogonal to the sheet transport direction. Mechanisms that are known for moving this rotating board include for example a mechanism in which the rotating board is rotationally moved upwards using a drive portion such as a lift up motor so that an area near a sheet transport direction downstream side end portion (hereinafter referred to as leading edge portion) of the sheets accommodated in the sheet housing portion is biased upwards (see JP H06-87543A and JP H07-187452A).

And although JP 2002-104677A (hereinafter referred as patent document 3) discloses a paper feeding device configured such that skewing or faulty paper feeding tends not to occur even with curled papers, it can hardly be said that this paper feeding device is capable of reliably preventing paper feeding problems caused by curling.

FIGS. 8A and 8B and FIGS. 9A and 9B are schematic views for describing a paper feeding device described in patent document 3. FIG. 8A shows a state in which sheets P, which are not curled, have been lowered within a sheet housing portion 80 and FIG. 8B shows a state in which the uncurled sheets P are being transported after being raised in the sheet housing portion 80. Furthermore, FIG. 9A shows a state in which sheets P, which have curled, have been lowered within the sheet housing portion 80 and FIG. 9B shows a state in which the curled sheets P are being transported after being raised in the sheet housing portion 80. It should be noted that the dashed line in FIG. 9B shows a transport trajectory of the sheet P leading edge.

In a paper feeding device 200' described in patent document 3, when an elevator platform 201' is caused to rotate from the state shown in FIG. 8A so as approach a first paper feeding roller 202 and a bundle of regular (not curled) sheets P is raised by the elevator platform 201', an uppermost positioned sheet P contacts the first paper feeding roller 202, and when the sheets P are further raised, a coupled portion detector piece 207*a* of a moving member 207 blocks the light of a photoelectric sensor 208, and the raising of the sheets P stops as shown in FIG. 8B. Then, the first paper feeding roller 202 feeds out the sheet P from the sheet housing portion 80 to a nip portion γ between a second paper feeding roller 203 and a separator roller 204, and the sheets P are transported sheet by sheet.

On the other hand, in the case where the sheets P have curled due to the effect of humidity or temperature or the like, when the bundle of curled sheets P is raised by the elevator platform 201' from the state shown in FIG. 9A, the sheets P make contact with a contact portion 207*b* of the moving member 207 that is separate from the first paper feeding roller 202 as shown in FIG. 9B, and when the sheets P are further raised, the coupled portion detector piece 207*a* of the moving member 207 blocks the light of the photoelectric sensor 208, and the raising of the sheets P stops. Due to the raising of the sheets P being hindered in this manner in response to the curled state of the sheets P, when the sheets P are to be supplied from the first paper feeding roller 202 to the nip portion γ between the second paper feeding roller 203 and the separator roller 204, their width direction side ends do not make contact with or do not make strong contact with an upper portion guide 205 that is secured in the device main unit (see the dashed dotted line in the diagrams).

However, when a transport guide member 206 is provided between the first paper feeding roller 202 and the second paper feeding roller 203, for example to smoothly guide the sheets P from the first paper feeding roller 202 to the second paper feeding roller 203, at least a portion of the transport guide member 206 may be positioned below the upper portion guide 205, which is intended to prevent contact of the sheets P. When this happens, in the paper feeding device described in patent document 3, although contact of the sheets P to the upper portion guide 205 can be prevented as shown in FIG. 9B, during transport of the sheets P, the sheets P may make contact with the portion of the transport guide member 206 that is positioned below the upper portion guide 205 (see the α portion in FIG. 9B), and when a leading edge portion P1 of the curled sheet P is transported while making contact with the transport guide member 206 in this manner, paper feeding problems may occur such as paper feeding delays due to reductions in the transport force caused by frictional load at the contact portion a between the sheet P and the transport guide member 206 or jamming due to obstruction of the leading edge portion of the sheet P.

SUMMARY OF THE INVENTION

The present invention has been devised in light of these problems and it is an object thereof to provide a paper feeding device and an image forming apparatus provided with this that are capable of reliably preventing paper feeding problems such paper feeding delays and jamming caused by curling even for sheets that have curled.

In order to address these issues, the present invention provides first and second configurations of a paper feeding device and an image forming apparatus.

(1) Paper Feeding Device of First Configuration

A paper feeding device is provided with a loading member in which a plurality of sheets can be loaded and stacked, and a central bending section configured to upwardly raise a central area in a sheet transport direction of the sheets stacked in the loading member.

(2) Paper Feeding Device of Second Configuration

A paper feeding device is provided with a loading member in which a plurality of sheets can be loaded and stacked, a curl detection section configured to upwardly raise a central area in a sheet transport direction of the sheets stacked in the loading member, and a central bending drive section for driving the central bending section, wherein in the case where it has been determined that a sheet is curled based on a state of curling of the sheet detected by the curl detection section, the central area of the sheets stacked in the loading member is upwardly raised due to an operation of the central bending section by the central bending drive section.

(3) Image Forming Apparatus

An image forming apparatus is provided with a paper feeding device according to the present invention.

With the paper feeding device according to the first configuration of the present invention, the central area of the sheets stacked in the loading member can be upwardly raised by the central bending section. In this way, even if the sheets are curled, the state of curling of the sheets can be effectively mitigated. Accordingly, it is possible to reliably prevent paper feeding problems such as paper feeding delays and jamming or the like caused by curling, even for curled sheets. This is particularly effective and desirable, for example, in the case where thick papers such as cardboards and glossy papers are used as the sheets.

Further still, in the second configuration, even when initially the sheets are in a regular (not curled) state, then curl due to changes in the ambient environment conditions or the like, the central area of the sheets stacked in the loading member can be automatically upwardly raised due to an operation of the central bending section by the central bending drive section in the case where it has been determined that a sheet is curled based on a state of curling of the sheet detected by the curl detection section. In this way, even without the user being aware of the state of curling of the sheets, paper feeding problems such as paper feeding delays and jamming caused by curling can be reliably prevented.

An example configuration of the present invention can be illustrated that is provided with an uptake section for pulling out an uppermost positioned sheet of the sheets stacked in the loading member, and a separation transport section for transporting sheet by sheet the sheets pulled out by the uptake section. In this configuration it is preferable that the curl detection section is provided between the uptake section and the separation transport section, and detects a state of curling of the sheet pulled out from the loading member by the uptake section.

In the present invention, a rotating board that is rotatable around an axis along a direction orthogonal to a sheet transport direction can be used as the loading member. An example of this configuration can be illustrated in which the central bending section is provided with a cam shaped cam member that rotates around an axis along a direction orthogonal to a sheet transport direction, and the central area of the sheets stacked in the loading member is upwardly raised by causing the cam member to rotate around the axis.

DESCRIPTION OF THE PREFERRED EMBODIMENTS

Hereinafter, embodiments of the present invention are described with reference to the accompanying drawings. It should be noted that the following embodiments are single specific examples of the present invention and are not of a nature that limits the scope of the present invention.

Figure 1:
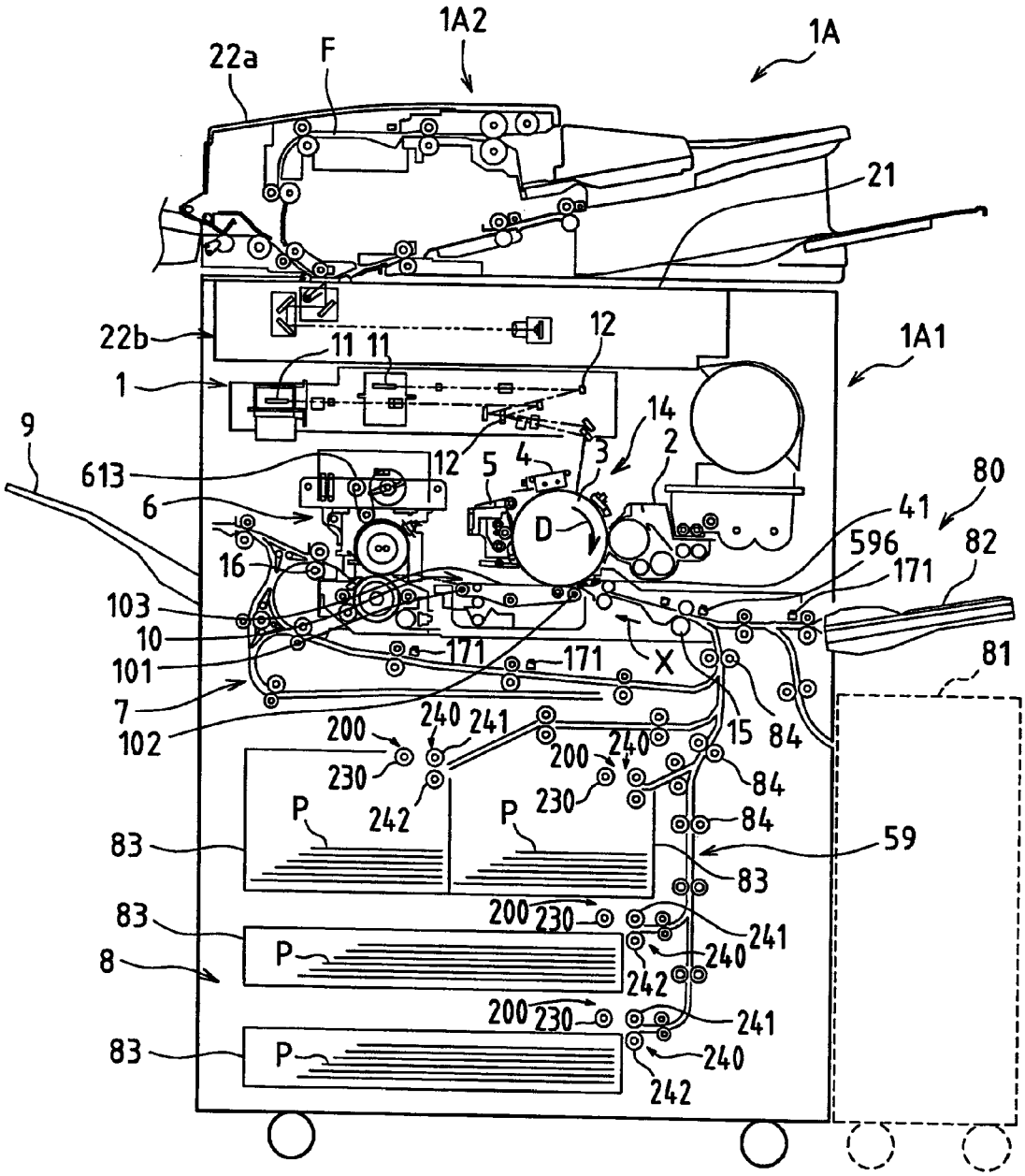
FIG. 1 shows an image forming apparatus provided with one example of a paper feeding device according to the present invention and is a diagram for describing an overall configuration of the image forming apparatus.
Figure 2:
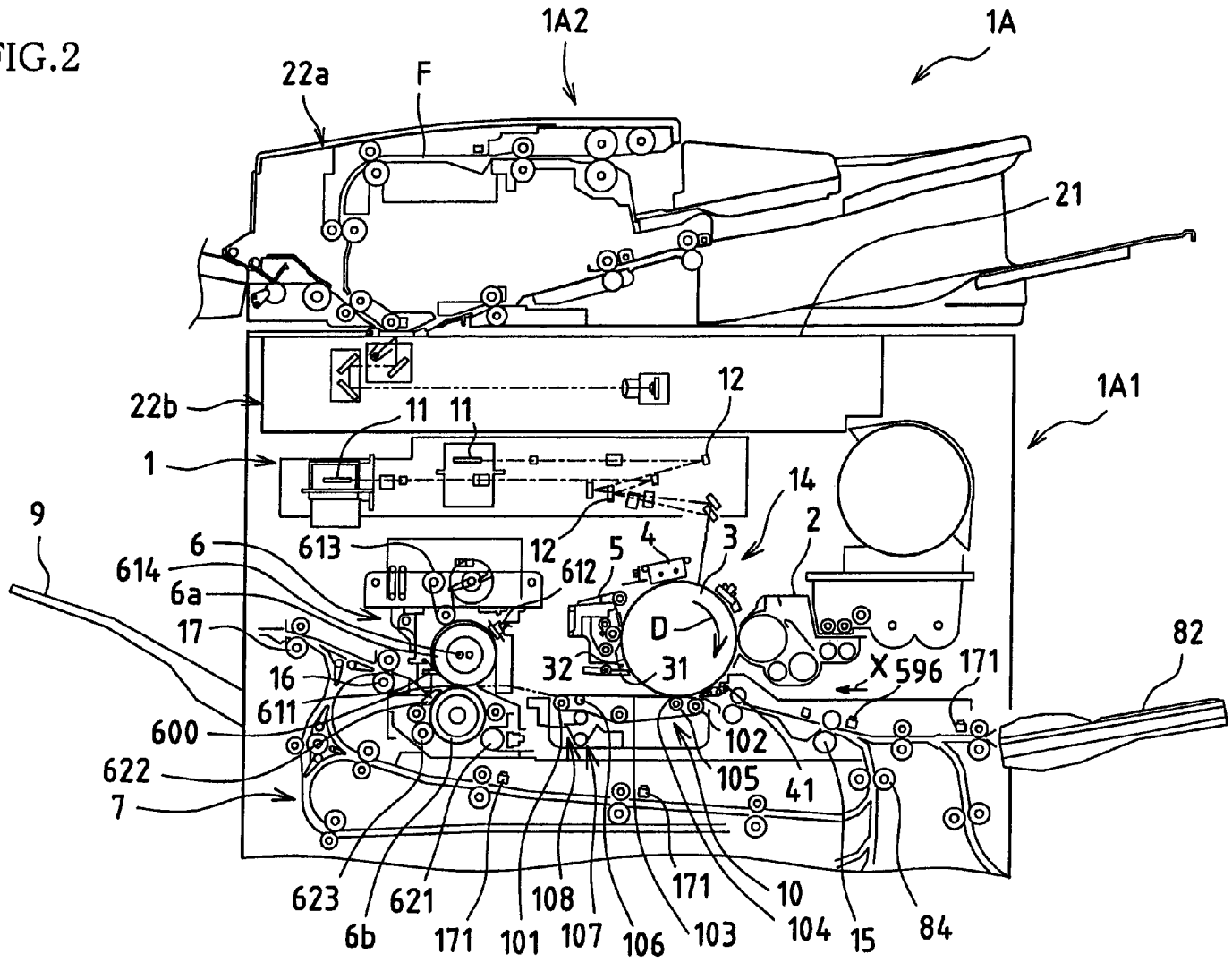
FIG. 2 is a diagram showing an image forming apparatus provided with one example of a paper feeding device according to the present invention, and is a detailed view showing image forming portions of the image forming apparatus.

FIG. 1 and FIG. 2 show an image forming apparatus provided with one example of a paper feeding device according to the present invention, with FIG. 1 being a diagram for describing an overall configuration of the image forming apparatus and FIG. 2 being a partial detailed view showing image forming portions of the image forming apparatus.

Overall Configuration of Image Forming Apparatus

First, description is given regarding the overall configuration of an image forming apparatus 1A with reference to FIG. 1 and FIG. 2. In the present embodiment, the image forming apparatus 1A shown in FIG. 1 forms images using an electrophotographic image forming process. The image forming apparatus 1A is provided with a photosensitive drum 3, a charging unit 4 for charging a surface of the photosensitive drum 3, an exposing unit 1 for forming an electrostatic latent image on the photosensitive drum 3, a development unit 2 for forming a toner image on the photosensitive drum 3 by developing the electrostatic latent image using a developer, a transfer unit 10 for transferring the toner image on the photosensitive drum 3 to a sheet such as a recording paper (hereinafter referred to as a paper) P, a fixing unit 6 for fixing the transferred image on the paper P to the paper P, a cleaning unit 5 for removing residual toner that has not been transferred by the transfer unit 10 and remains on the surface of the photosensitive drum 3, a neutralizing device 41 for neutralizing the charge on the photosensitive drum 3, and a main control portion 54 (not shown in FIG. 1, see FIG. 3, which is described later).

The image forming apparatus 1A forms a monochrome (single color) image on the paper P in accordance with image data read from an original or image data received from an external device not shown. Broadly divided, the configuration of the image forming apparatus 1A is constituted by an apparatus main unit 1A1 and an automatic document processing device 1A2. The apparatus main unit 1A1 is provided with an image forming portion 14, a paper transport path 59, a paper transport portion 7, and a paper feeding portion 8.

An original stage 21 constituted by transparent glass where originals are placed is provided at an upper surface portion of the apparatus main unit 1A1, and the automatic document processing device 1A2 is provided above the original stage 21 so as to readily swing open upwards.

The automatic document processing device 1A2 is provided with an automatic document feeding device 22*a* that transports originals (not shown in drawings) along an original transport path F and a scanner portion 22*b* that acts as an original reading portion that reads image information of an original that has been transported in or an original that has been positioned.

The image forming portion 14 and a discharge tray 9 are arranged below the scanner portion 22*b*, and below that is arranged the paper feeding portion 8, which accommodates a plurality of sheets P.

The image forming portion 14 is for recording an image onto the paper P based on the image data, and is provided with the aforementioned photosensitive drum 3, the charging unit 4, the exposing unit 1, the development unit 2, the transfer unit 10, the neutralizing device 41, the cleaning unit 5, and the fixing unit 6.

Here, the photosensitive drum 3 is presented as cylindrical in shape, arranged below the exposing unit 1, and is rotated in a predetermined direction (direction of arrow D in the diagrams) by a drive section (not shown). Along an outer circumferential surface of the photosensitive drum 3 and toward a downstream side of the rotation direction D of the photosensitive drum, using as a reference the positioning after completion of image transfer, are arranged a paper separation claw 31, the cleaning unit 5, the charging unit 4 that acts as an electric field generating portion, the development unit 2, and the neutralizing device 41 in this order.

The paper separation claw 31 is arranged so as to be capable of being brought into and out of contact with the outer circumferential surface of the photosensitive drum 3 by a solenoid 32. When it has been brought in contact with the outer circumferential surface of the photosensitive drum 3, the paper separation claw 31 separates any paper P that has become stuck to the surface of the photosensitive drum 3 when the unfixed toner image on the photosensitive drum 3 is transferred to the paper P.

It should be noted that instead of the solenoid 32, a drive motor or the like may also be employed as a drive section of the paper separation claw 31, and it is also possible to select other drive section.

The charging unit 4 acts as a charging section for uniformly charging the surface of the photosensitive drum 3 to a predetermined electric potential and is arranged above the photosensitive drum 3 in close proximity to the outer circumferential surface thereof. In the present embodiment, the charging unit 4 is a charger type component. It should be noted that the charging unit 4 may also be a roller type or brush type unit that makes contact with the photosensitive drum 3.

In the present embodiment, the exposing unit 1 is a laser scanning unit (LSU) provided with two laser irradiation portions 11, and two mirror groups 12. The exposing unit 1 launches laser light in response to the image data (image information for printing), which is outputted from an image processing portion 57 (not shown in FIG. 1 and FIG. 2, see FIG. 3), from the laser irradiation portions 11 respectively. Furthermore, the exposing unit 1 irradiates laser light from the laser irradiation portions 11 via the mirror groups 12 respectively onto the photosensitive drum 3 to expose the surface of the photosensitive drum 3, which has been charged uniformly by the charging unit 4, and in this way an electrostatic latent image is formed on the surface of the photosensitive drum 3. In the present embodiment, the exposing unit 1 employs a two beam system provided with the two laser irradiation portions 11 to support high speed image forming processing, which enables the load to be decreased along with faster irradiation timings. It should be noted that instead of the laser scanning unit, an EL writing head or an LED writing head in which light-emitting elements are lined up in an array may be used as the exposing unit 1.

The development unit 2 supplies toner to the surface of the photosensitive drum 3 to develop (make visible) the electrostatic latent image and form a toner image on the surface of the photosensitive drum 3. The development unit 2 is arranged substantially horizontally (on the right side in the diagrams) on a downstream side from the charging unit 4 in the rotation direction D of the photosensitive drum 3 in close proximity to the photosensitive drum 3.

By applying from the transfer unit 10 an electric field of an opposite polarity to the charge of the electrostatic latent image, which has been made a manifest image on the photosensitive drum 3, to the paper P that is transported in, the toner image on the photosensitive drum 3 is transferred onto the paper P.

In the present embodiment, the transfer unit 10 is provided with a transfer belt 103, a drive roller 101, an idler roller 102, and an elastic conductive roller 105. The transfer belt 103 spans the rollers 101, 102, and 105. The transfer unit 10 is arranged below the photosensitive drum 3 such that the surface of the transfer belt 103 touches a portion of the outer circumferential surface of the photosensitive drum 3. Due to the transfer belt 103, the paper P is pressed against the photosensitive drum 3 while being transported.

The surface of the transfer belt 103 moves due to rotation of the rollers 101, 102, and 105, thereby transporting the paper P that has been placed on that surface. The transfer belt 103 has a predetermined resistance value (for example, $1\times10^{9}$ to $1\times10^{13}$ Ω/cm). The elastic conductive roller 105, to which can be applied a transfer electric field of a different conductivity to the drive roller 101 and the idler roller 102, is arranged at a contact area 104 between the photosensitive drum 3 and the transfer belt 103. The elastic conductive roller 105 presses against the surface of the photosensitive drum 3 through the transfer belt 103. Due to this, the paper P on the surface of the transfer belt 103 can be pressed against the surface of the photosensitive drum 3. The transfer electric field having an opposite polarity to the charge of the toner image on the surface of the photosensitive drum 3 is applied to the elastic conductive roller 105. Due to this transfer electric field of an opposite polarity, the toner image on the surface of the photosensitive drum 3 can be transferred to the paper P on the transfer belt 103. For example, when the toner image has a charge of a negative (−) polarity, the polarity of the transfer electric field applied to the elastic conductive roller 105 is a positive (+) polarity. In this transfer unit 10, the elastic conductive roller 105 is constituted by a soft material such as elastic rubber or a foam resin or the like. Due to the elasticity of the elastic conductive roller 105, the photosensitive drum 3 and the transfer belt 103 do not make line contact, but rather make surface contact having a predetermined width (referred to as a so-called transfer nip) 104. Due to this, the transfer efficiency onto the transported paper P can be improved.

Further still, at a downstream side in the paper transport direction (arrow X direction in the diagrams) from the transfer region of the transfer belt 103, a neutralizing roller 106 is arranged touching a rear surface of the transfer belt 103 (a surface on an opposite side from the surface where the papers P are transported). The neutralizing roller 106 neutralizes the electric field that has been applied to the transported paper P at the transfer region and ensures that transport to subsequent processing is carried out smoothly. Furthermore, a neutralizing mechanism 108 is arranged at the transfer unit 10. The neutralizing mechanism 108 carries out neutralization on a belt cleaning unit 107, which removes toner from the transfer belt 103, and on the transfer belt 103. A technique of performing grounding via the apparatus or a technique of actively applying an opposite polarity to the polarity of the transfer electric field are available as techniques that can be used for carrying out neutralization in the neutralizing mechanism 108.

The electrostatic image (unfixed toner) that has been transferred to the paper P by the transfer unit 10 is transported to the fixing unit 6 where it undergoes pressure and heating such that the unfixed toner melts and becomes fixed onto the paper P.

The fixing unit 6 applies heat and pressure to the paper P to cause the toner image to thermally fix onto the paper P. Specifically, the fixing unit 6 is provided with a hot roller **6*a* and a pressure roller 6*b*, and the hot roller 6*a* is rotated while the paper P is being sandwiched by the hot roller 6*a* and the pressure roller 6*b* so as to pass between the hot roller 6*a* and the pressure roller 6*b***, thereby melting and fixing the toner image that had been transferred to the paper P.

Transport rollers 16 that transport the paper P are arranged on a downstream side in the paper transport direction X of the fixing unit 6.

A paper separation claw 611, a roller surface temperature detection member (thermistor) 612, and a roller surface cleaning member 613 are arranged on an outer circumferential surface of the hot roller **6*a*. A heat source 614 is provided on an inner side of the hot roller 6*a* in order to heat the surface of the hot roller 6*a* to a predetermined temperature (fixing temperature: approximately 160° C. to 200° C.). Furthermore, a pressure-applying member not shown in the drawings is arranged at both ends of the pressure roller 6*b* so that the pressure roller 6*b* is pressed into contact with the hot roller 6*a* with a predetermined pressure. A pressure-applying member 621 capable of pressing the pressure roller 6*b* against the hot roller 6*a* with a predetermined amount of pressure is arranged at both ends of the pressure roller 6*b*, and further still, a paper separation claw 622 and a roller surface cleaning member 623 are arranged on an outer circumferential surface of the pressure roller 6*b* in the same manner as the outer circumferential surface of the hot roller 6*a***.

When the paper P is transported to a pressing portion (referred to as a so-called fixing nip portion) 600 between the hot roller **6*a* and the pressure roller 6*b*, the fixing unit 6 subjects the unfixed toner image on the paper P to thermal melting and pressure while the paper P is being transported by the rollers 6*a* and 6*b***. Due to this, the unfixed toner image can be fixed onto the paper P.

The neutralizing device 41 serves as a pre-transfer neutralizing section for reducing the surface electric potential of the photosensitive drum 3 so that the toner image formed on the surface of the photosensitive drum 3 is easily transferred to the paper P. The neutralizing device 41 is arranged on a downstream side from the development unit 2 in the rotation direction D of the photosensitive drum in close proximity to the photosensitive drum 3.

It should be noted that in the present embodiment, the neutralizing device 41 is configured using a neutralizing electrode, but a neutralizing lamp may be used instead of a neutralizing electrode, and it is also possible to perform neutralization using other methods.

The cleaning unit 5 removes and collects toner that is residual on the surface of the photosensitive drum 3 after development and transfer. The cleaning unit 5 is arranged substantially horizontally (left side in the diagrams) lateral to the photosensitive drum 3 in a position substantially opposing the development unit 2 sandwiching the photosensitive drum 3.

The paper transport path 59 guides the paper P from a paper housing portion 80 in the paper feed portion 8 to the image forming portion 14. Specifically, a plurality of pairs of transport rollers 84 and a pair of registration rollers 15 are provided on the paper transport path 59 in order to transport the paper P. The pair of registration rollers 15 are operated by an unshown drive section so as to transport the papers P from the plurality of pairs of transport rollers 84 between the photosensitive drum 3 and the transfer belt 103 in synchronization with the electrostatic latent image on the photosensitive drum 3. The pair of registration rollers 15 is arranged on an upstream side from the photosensitive drum 3 in the paper transport direction X and on a downstream side from the plurality of pairs of transport rollers 84.

In the present embodiment, the paper housing portion 80 and paper feeding devices 200 are provided in the paper feeding portion 8. The paper housing portion 80 is constituted by a large capacity cassette (LCC) 81, a manual feeding tray 82, and a plurality of paper feeding trays 83. The plurality of pairs of transport rollers 84 in the paper transport path 59 are configured to take in the papers P from the paper feed trays 83 using the paper feeding devices 200, and transport the paper P until a leading edge portion of the paper P reaches the registration rollers 15. That is, the plurality of pairs of transport rollers 84 are configured to transport the paper P such that the leading edge portion of the paper P reaches and contacts the registration rollers 15, which are temporarily stopped, until the paper P bends there. Due to an elastic force of the bent paper P, the leading edge portion of the paper P can be aligned parallel to the registration rollers 15. After this, due to the registration rollers 15 being rotationally driven, the paper P is transported to the transfer unit 10 of the image forming portion 14.

The paper transport portion 7 is configured such that the paper P, which has undergone image forming by the image forming portion 14, is transported by discharge rollers 17 to the discharge tray 9.

It should be noted that paper detection sensors 171 constituting paper transport detection devices 170 (not shown in FIG. 1 and FIG. 2, see FIG. 3) that detect a position or the like of the papers P are arranged in various locations in the paper transport portion 7. In this way, the transport rollers 84 and the registration rollers 15 are rotationally driven in accordance with positions of the papers P detected by the various sensors such that the papers P undergo transport and positioning control.

The paper feeding devices 200 are provided corresponding to the plurality of paper feeding trays 83 that constitute the paper housing portion 80.

The paper feeding trays 83 are components for accumulating multiple sheets of the papers P on which image information has been outputted (printed), and are mounted on the paper feeding portion 8 below the image forming portion 14.

Since an object of the image forming apparatus 1A in the present embodiment is high speed image forming, each of the paper feeding trays 83 ensures a capacity capable of storing from 500 to 1,500 sheets of standard size papers P such as A4, A3, B4, and the like.

Also, the large capacity cassette (LCC) 81 and the manual feeding tray 82 are provided on a lateral surface of the image forming apparatus 1A. The large capacity cassette 81 is capable of housing a large amount of multiple types of papers P. The manual feeding tray 82 is mainly for supplying non-standard sizes and/or small amounts of the papers P.

The discharge tray 9 is arranged at a lateral surface of the image forming apparatus 1A on an opposite side to the manual feeding tray 82. Instead of the discharge tray 9, the image forming apparatus 1A can be configured such that post processing devices for discharged papers (for example, post processing devices for stapling, punching or the like) or a plurality of levels of discharge trays are arranged as options.

In the above-described image forming apparatus 1A, the papers P that are supplied from the paper housing portion 80 are transported sheet by sheet by the paper transport portion 7 between the photosensitive drum 3 and the transfer unit 10, and the toner image that has been formed on the photosensitive drum 3 is transferred to the paper P. Then, the unfixed toner image is fixed to the paper P by the fixing unit 6. After this, the paper P on which the toner image has been fixed is processed in accordance with a specified processing mode and discharged to the discharge tray 9.

Control System of Image Forming Apparatus

Figure 3:
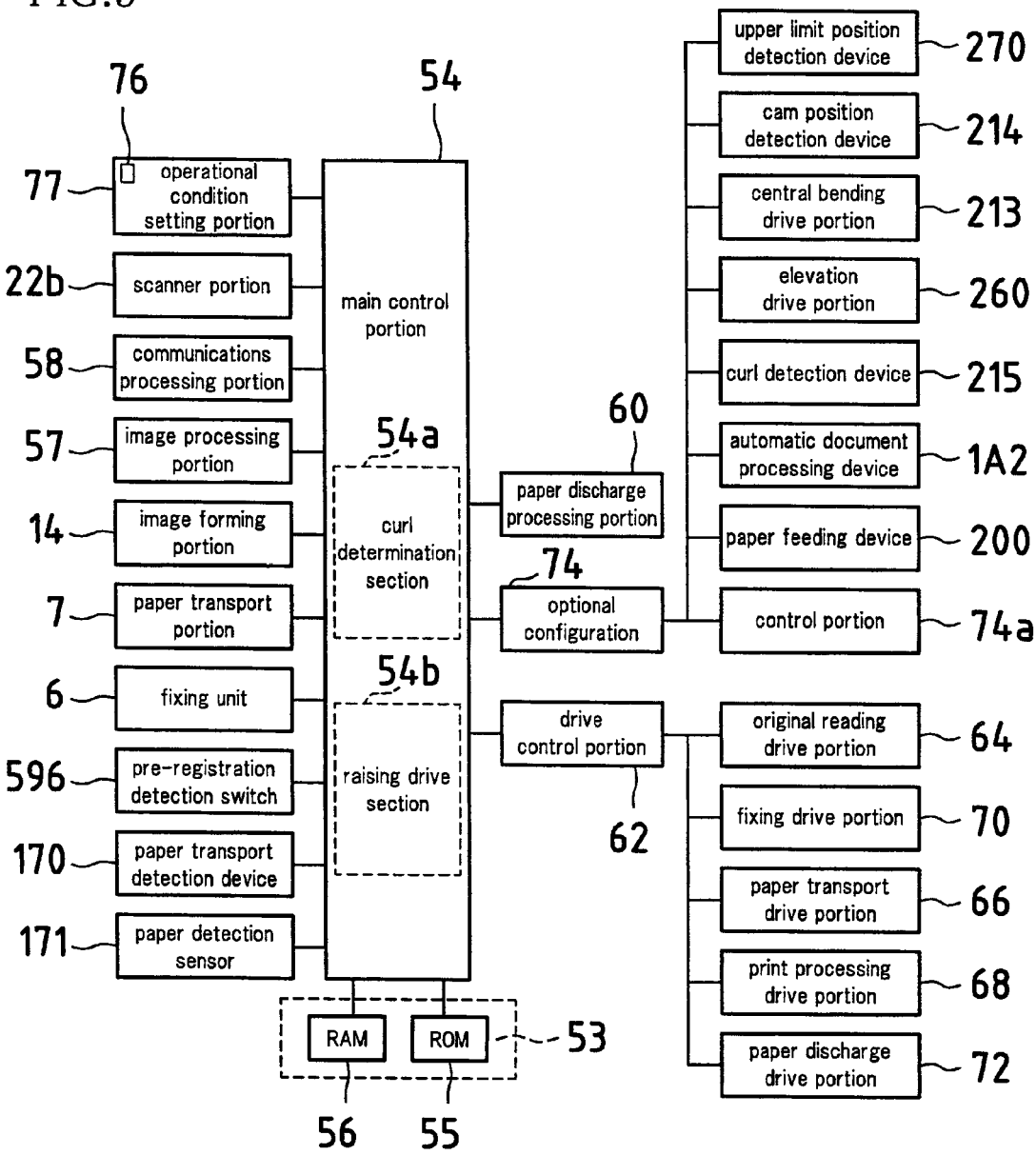
FIG. 3 is a block diagram that schematically shows a control configuration of the image forming apparatus shown in FIG. 1 and FIG. 2.

Next, description is given regarding a control system of the image forming apparatus 1A shown in FIG. 1 and FIG. 2 with reference to FIG. 3. FIG. 3 is a block diagram that schematically shows a control configuration of the image forming apparatus 1A shown in FIG. 1 and FIG. 2.

As shown in FIG. 3, the main control portion 54 provided in the image forming apparatus 1A controls overall operations of the image forming apparatus 1A, is constituted by a central processing unit such as a CPU or the like, and is connected to a storage portion 53. The storage portion 53 includes semiconductor memories such as a ROM (read only memory) 55 and a RAM (random access memory) 56.

The ROM 55 stores control programs, which are procedures for processing to be executed by the main control portion 54. The RAM 56 provides a work area for operations.

The main control portion 54 uses a temporary storage section such as the RAM 56 to execute processing such as image reading processing, image processing, image forming processing, and transport processing for the papers P in accordance with programs stored in advance in the ROM 55.

It should be noted that storage section such as a HDD (hard disk drive) can be used instead of semiconductor memories such as the ROM 55 and the RAM 56.

In the image forming apparatus 1A, image information (original image data) of the original read by the scanner portion 22*b*, or original image information that has been sent from any of various terminal devices that are connected by an unshown communications network is inputted to the image processing portion 57 via a communications processing portion 58.

The image processing portion 57 uses the aforementioned programs to process the original image information stored in the storage portion 53 such as the RAM 56 into image information for printing suited to printing (image forming onto the papers P). The image information for printing is inputted to the image forming portion 14.

The image forming portion 14, the paper transport portion 7 that carries out various types of detection and control of the papers P in the paper transport path 59 or the like, the fixing unit 6 and a paper discharge processing portion 60 that carries out various types of detection and control of the papers P in the discharge rollers 17 work in cooperation with a drive control portion 62.

Through a printing process (a process of printing the image information in the image forming portion 14) and thereafter a fixing process (fixing unit 6) on the paper that has undergone the print processing, the paper P that is transported by the paper transport portion 7 is discharged to the discharge tray 9, which is a paper discharge portion.

It should be noted that in the paper transport portion 7, detection signals of a pre-registration detection switch 596, the paper detection sensors 171, an unshown fixing detection switch, and a discharge detection switch and the like are inputted to an input system of the main control portion 54.

The pre-registration detection switch 596 is a switch that detects whether or not the paper P has reached the registration rollers 15. The fixing detection switch is a switch that detects whether or not the paper P has reached the fixing unit 6. The discharge detection switch is a switch that detects whether or not the paper P has been discharged. Furthermore, a transport status of the paper P transported on the paper transport path 59 is detected by the paper detection sensors 171.

And the main control portion 54 is configured to carry out timing control of members such as motors, solenoids, and lamps and the like that are connected to its output system based on input signals from members such as various sensors and switches and the like connected to its input system.

Furthermore, an operational condition setting portion 77 is provided in the image forming apparatus 1A. The operational condition setting portion 77 is for setting operational conditions such as image forming or transport conditions of the image forming apparatus 1A in response to image forming requests set by a user using various operating switches 76 or image forming conditions of various types of papers P.

Furthermore, the image forming apparatus 1A carries out operations of an original reading drive portion 64, a paper transport drive portion 66, a print processing drive portion 68, a fixing drive portion 70, and a paper discharge drive portion 72 using the control of the drive control portion 62 in accordance with the operating conditions that have been set. These operations are carried out in synchronization in accordance with instructions of the main control portion 54 based on the programs stored in the ROM 55.

The original reading drive portion 64 is an actuator for driving the scanner portion 22*b*. The paper transport drive portion 66 is an actuator for driving the paper transport portion 7 and here is a motor for driving the paper transport portion 7. More specifically, the paper transport drive portion 66 is a motor for driving an uptake member 230, which is described later, and the registration rollers 15 of the paper feeding devices 200, which are described later, arranged on a paper transport direction X upstream side from the paper transport path 59. The print processing drive portion 68 is an actuator for driving the image forming portion 14 and here is a motor for driving the photosensitive drum 3. The fixing drive portion 70 is an actuator for driving the fixing unit 6 and here is a motor for driving the hot roller 6*a* and the pressure roller 6*b* of the fixing unit 6. The paper discharge drive portion 72 is an actuator for driving the paper discharge processing portion 60 and here is a motor for driving the discharge rollers 17 and the like.

The drive motors of these drive portions can be configured using an appropriate power transmission mechanism, using as a drive source the same or different motors.

Further still, post processing devices (stapling devices, punching devices, multilevel discharge trays, shifters, and the like) and automatic original reading devices (the automatic document processing device 1A2 or the like) can be arranged as optional configurations 74 for the image forming apparatus 1A, and these optional configurations 74 are configured to have their timings adjusted to be in synchronization with the apparatus via the communications processing portion 58 while having their own control portions 74*a* inside the optional configurations 74 separate from the main control portion 54 of the image forming apparatus 1A.

Paper Feeding Device Configuration

Next, description is given regarding the paper feeding devices 200 according to an embodiment of the present invention with reference to FIG. 4 and FIG. 5. It should be noted that here description is given using an example of a case in which a paper feeding device 200 has been applied to a paper feeding tray 83 within the paper housing portion 80.

Figure 4A:
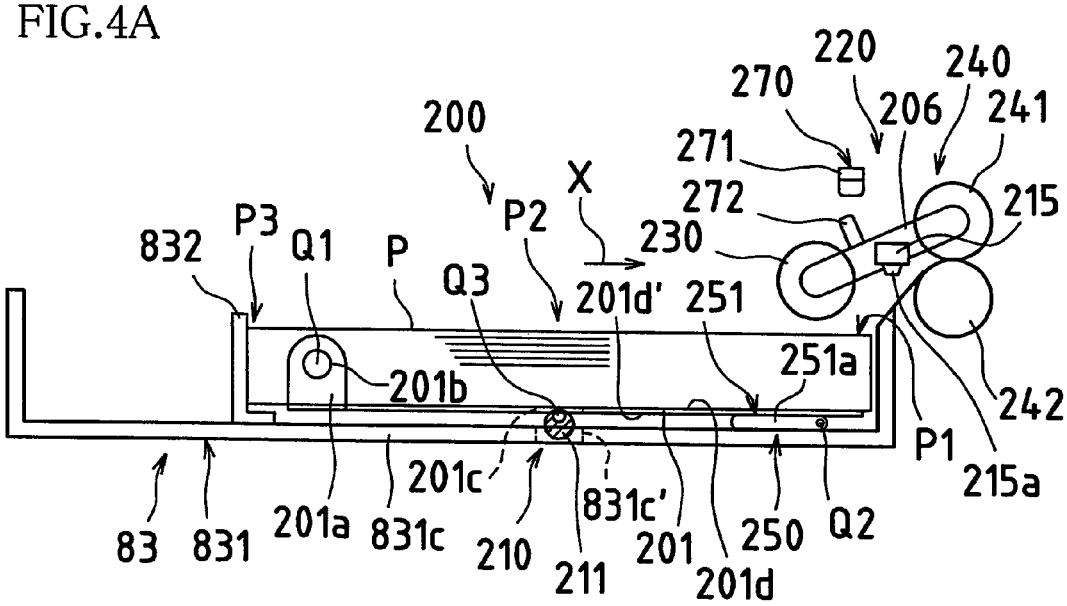
FIG. 4A is a diagram for describing an outline configuration of a paper feeding device according to an embodiment of the present invention and a paper feeding tray provided with this, and is a perspective view of a state in which uncurled papers are lowered within the paper feeding tray as viewed from the front.
Figure 4B:
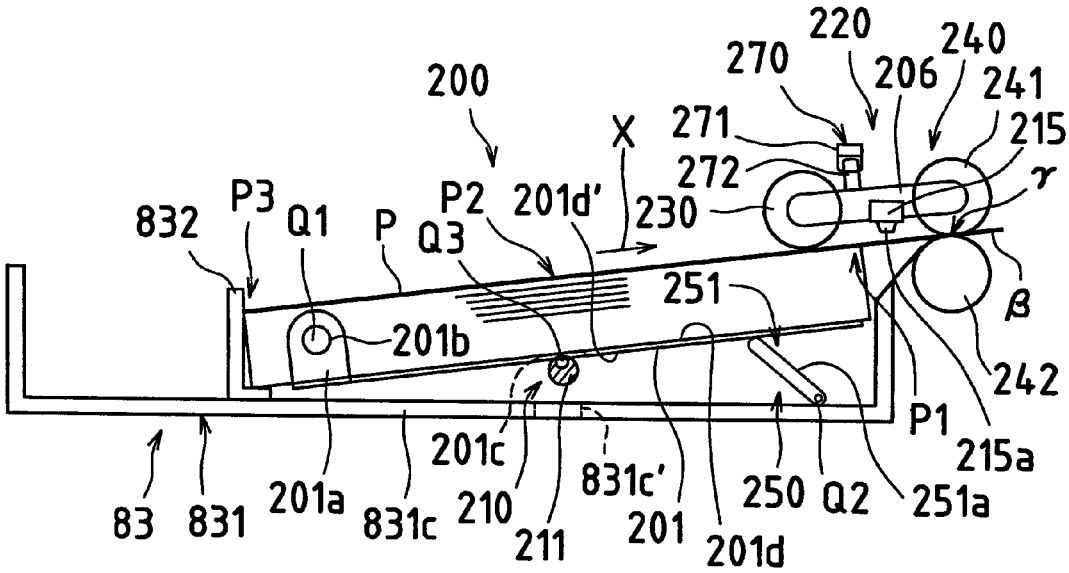
FIG. 4B is a diagram for describing an outline configuration of a paper feeding device according to an embodiment of the present invention and a paper feeding tray provided with this, and is a perspective view of a state in which uncurled papers are raised within the paper feeding tray as viewed from the front.
Figure 5A:
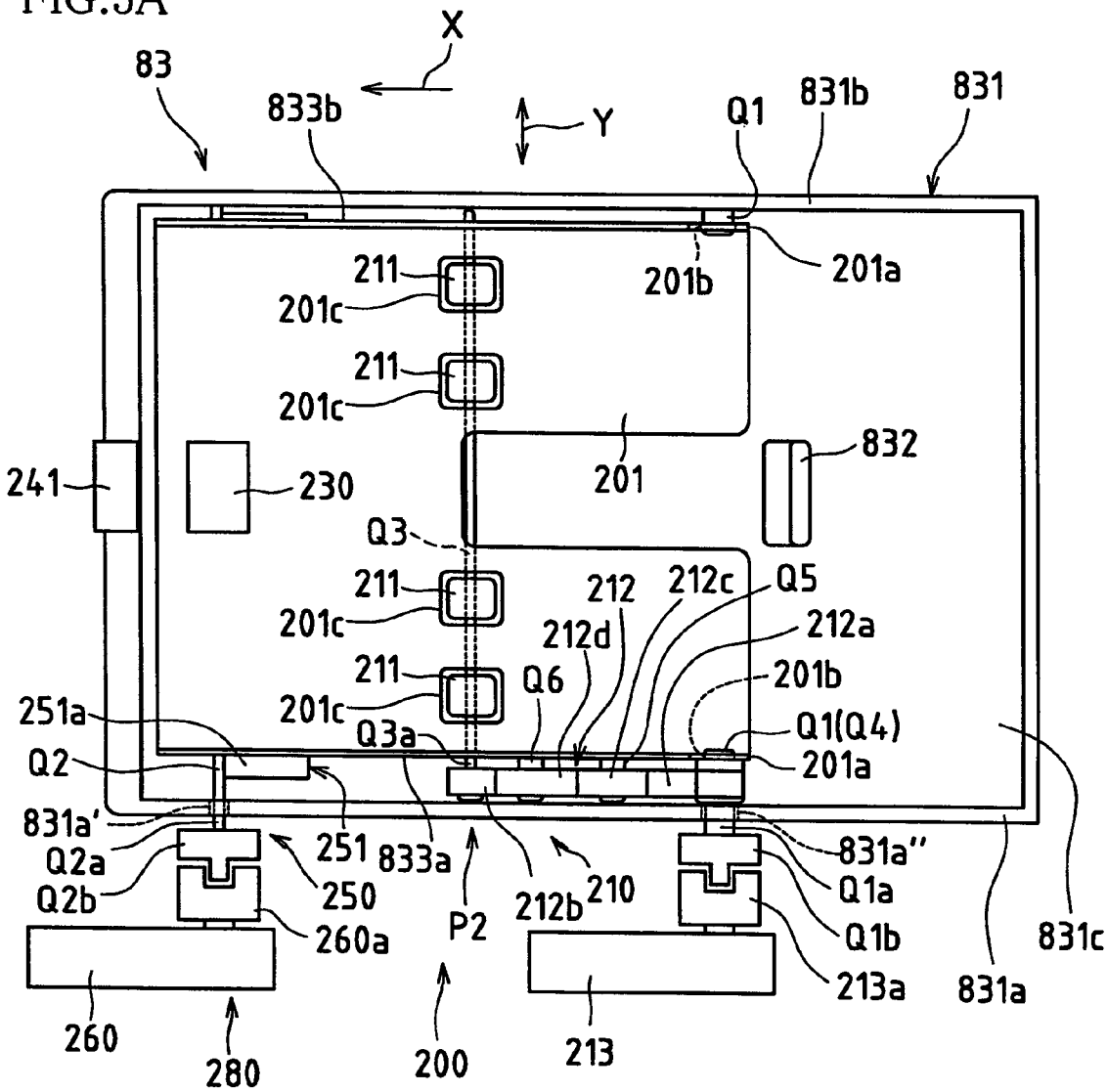
FIG. 5A is a diagram for describing an outline configuration of the paper feeding device and the paper feeding tray shown in FIG. 4A and FIG. 4B, and is a top view of the paper feeding device and the paper feeding tray.
Figure 5B:
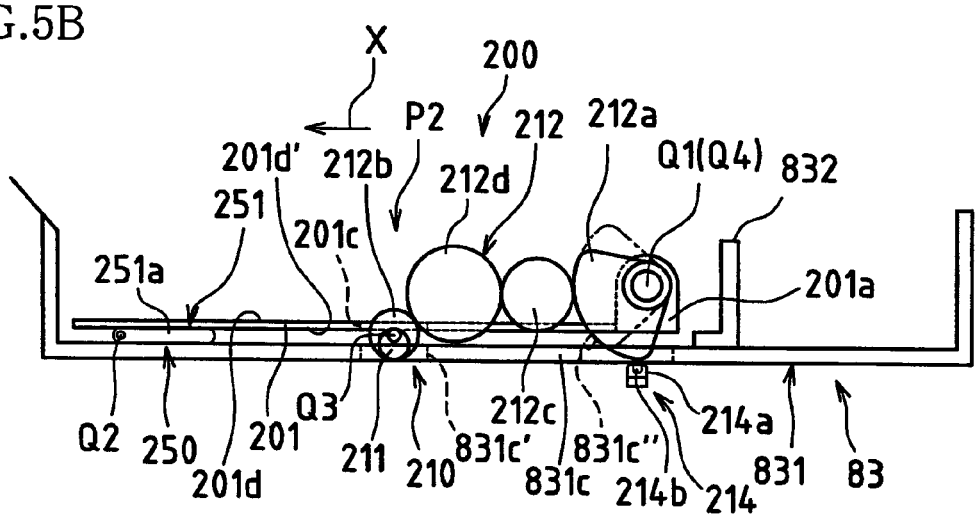
FIG. 5B is a diagram for describing an outline configuration of the paper feeding device and the paper feeding tray shown in FIG. 4A and FIG. 4B, and is a perspective view of the paper feeding device and the paper feeding tray as viewed from a rear surface.

FIG. 4 is a diagram for describing an outline configuration of a paper feeding device 200 according to an embodiment of the present invention and a paper feeding tray 83 provided with this, with FIG. 4A being a perspective view of a state in which uncurled papers P are lowered within the paper feeding tray 83 as viewed from the front, and FIG. 4B being a perspective view of a state in which uncurled papers P are raised within the paper feeding tray 83 as viewed from the front. Furthermore, FIG. 5 is a diagram for describing an outline configuration of the paper feeding device 200 and paper feeding tray 83 shown in FIG. 4, with FIG. 5A being a top view of the paper feeding device 200 and the paper feeding tray 83, and FIG. 5B being a perspective view of the paper feeding device 200 and the paper feeding tray 83 as viewed from the rear. It should be noted that FIG. 5 omits components such as an upper limit position detection device 270 shown in FIG. 4.

The paper feeding tray 83 is provided with a housing container 831 that houses papers P, a first restraining member 832 that restrains the papers P housed in the housing container 831 from moving backward from a paper transport direction X upstream side end portion P3, and second restraining members 833*a* and 833*b* that restrain a position of the papers P housed in the housing container 831 in a horizontal direction (arrow Y direction in FIG. 5A) orthogonal to the paper transport direction X.

The paper feeding device 200 is provided with a loading member 201. The loading member 201 is capable of being stacked with a plurality of the papers P.

In the present embodiment, the loading member 201 is capable of being stacked with a plurality of the papers P and is capable of elevating vertically at least a leading edge portion P1 in the paper transport direction X, and here is configured as a rotating board rotatable around an axis along a direction Y orthogonal to the paper transport direction X. Specifically, the housing container 831 and the loading member 201 (hereinafter referred to as rotating board 201) are both rectangular as viewed from above and the rotating board 201 is housed inside the housing container 831.

The paper feeding device 200 is further provided with a paper feeding mechanism 220. The paper feeding mechanism 220 is provided with a pickup roller 230 as an uptake member that acts as an uptake section for pulling out the uppermost positioned paper P stacked in the rotating board 201 and housed in the paper feeding tray 83, a separation transport mechanism 240 that acts as a separation transport section for transporting sheet by sheet the papers P that have been pulled out by the pickup roller 230, an elevating device 280 that vertically elevates at least the leading edge portion P1 side of the rotating board 201, and the upper limit position detection device 270 that detects an upper limit position of the rotating board 201. In the present embodiment, the elevating device 280 is provided with an elevating mechanism 250 that vertically elevates the leading edge portion P1 of the rotating board 201 on a rotation shaft Q1 arranged along the direction Y orthogonal to the paper transport direction X, and an elevation drive portion 260 that drives the elevating mechanism 250. The elevation drive portion 260 here is an actuator for elevation driving such as a lift-up motor or the like. And the paper feeding device 200 uses the drive of the elevation drive portion 260 to sequentially pull out (pick up) with the pickup roller 230 the uppermost positioned paper P among the papers P placed in the rotating board 201, which has been raised by the elevating mechanism 250 and sort the paper P using the separation transport mechanism 240, thereby performing sheet by sheet supply to the paper transport path 59.

The pickup roller 230 is arranged at an upper portion on the paper discharge (paper P leading edge portion P1) side of the paper feeding tray 83. The separation transport mechanism 240 is provided with a paper feeding roller 241 arranged at an upper surface side of the paper P pulled out by the pickup roller 230 and a separation roller 242 that serves as a separation member in opposition to the paper feeding roller 241.

The pickup roller 230 readily swivels on an axis of the paper feeding roller 241. Furthermore, the pickup roller 230 is rotationally driven in the same direction as the paper feeding roller 241. And a transport guide member 206 is provided between the pickup roller 230 and the paper feeding roller 241 to smoothly guide the paper P from the pickup roller 230 to the paper feeding roller 241. The transport guide member 206 readily swivels on an axis of the paper feeding roller 241 and supports the pickup roller 230 to readily rotate on an axis.

The rotating board 201 is supported to readily rotate on the rotation shaft Q1 at support members 831*a* and 831*b* (see FIG. 5A) at edge portions on an opposite side from the paper discharge side of the rotating board 201.

The support members 831*a* and 831*b* are side panels on either side of the housing container 831 in the direction Y orthogonal to the paper transport direction X, and these side panels 831*a* and 831*b* support the rotation shafts Q1 respectively. The rotating board 201 has engaging fulcrum portions 201*a* that extend upward at side edge portions in the direction Y orthogonal to the paper transport direction X at side edge portions opposite the paper discharge side. Pass-through holes 201*b* that pass through in the direction Y orthogonal to the paper transport direction X are arranged on the engaging fulcrum portions 201*a*. And the rotation shafts Q1 insert into the pass-through holes 201*b* to readily rotate on their axes. In this way, the rotating board 201 is supported by the side panels 831*a* and 831*b* via the rotation shafts Q1 to readily rotate on the rotation shafts Q1.

The elevating mechanism 250 is provided with an elevating member 251 that vertically elevates the rotating board 201 at the paper discharge side through rotation on the rotation shafts Q1.

The elevating member 251 is provided with a rotation shaft Q2 arranged along the direction Y orthogonal to the paper transport direction X and a rotation portion 251*a* that is supported on this rotation shaft Q2, and is arranged between the rotating board 201 and a bottom panel 831*c* of the housing container 831. The rotation shaft Q2 is supported to readily rotate on its axes at the side panels 831*a* and 831*b* of the housing container 831. Furthermore, the rotation shaft Q2 has a protruding portion Q2*a* that protrudes outwardly from the side panel 831*a* on one side of the housing container 831. That is, a pass-through hole 831*a*' that passes through in the direction Y orthogonal to the paper transport direction X is arranged on the side panel 831*a* on one side of the housing container 831. And the rotation shaft Q2 inserts into the pass-through holes 831*a*' to readily rotate on it axis.

Furthermore, an engaging portion Q2*b* that engages with a movable portion 260*a* of the elevation drive portion 260 is securely connected to the protruding portion Q2*a* of the rotation shaft Q2. It should be noted that at least one of the engaging portion Q2*b* of the rotation shaft Q2 and the movable portion 260*a* of the elevation drive portion 260 readily moves along the rotation shaft Q2 and applied with a biasing force to the other side. And when mounting or after mounting the engaging portion Q2*b* of the rotation shaft Q2 and the movable portion 260*a* of the elevation drive portion 260 to the paper feeding portion 8 of the paper feeding tray 83, by rotating the movable portion 260*a* with the engaging portion Q2*b* and the movable portion 260*a* engaging with each other in a concavo-convex manner, the engaging portion Q2*b* rotates accompanying rotation of the movable portion 260*a*.

The rotation portion 251*a* is provided extending toward an outer side in a diameter direction of the rotation shaft Q2 at one portion of the circumferential direction of the rotation shaft Q2. By contacting and sliding along a bottom surface 201*d*' of the rotating board 201 due to the axial rotation of the rotation shaft Q2, the rotation portion 251*a* is capable of achieving a lowered posture, in which the rotating board 201 is in a parallel state with the bottom panel 831*c* of the housing container 831, and a raised posture, in which the paper discharge side of the rotating board 201 rises to put the rotating board 201 into a tilted state. And by causing the rotation shaft Q2 to rotate by the movable portion 260*a* via the engaging portion Q2*b*, the elevation drive portion 260 is capable of vertically elevating the rotating board 201 by the rotation portion 251*a* on the rotation shafts Q1 on the paper discharge portion side.

The upper limit position detection device 270 is provided with a first detection member 271, which is secured in a predetermined position, and a second detection member 272, which is installed at a portion that elevates due to the driving of the elevation drive portion 260. The first and second detection members 271 and 272 are put into a detection state (here, an ON state) by movement of the second detection member 272 accompanying the driving of the elevation drive portion 260, thereby making the upper limit position detection device 270 capable of detecting a predetermined standard upper limit position of the rotating board 201. Here, the standard upper limit position refers to a position at which a straight path β extending from the uppermost positioned regular (uncurled) paper P stacked on the rotating board 201 along a surface of this uppermost position passes through a nip portion γ between the paper feeding roller 241 and the separation roller 242 (see FIG. 4B).

Here, the first detection member 271 is configured as a photosensor secured at a predetermined position on the paper feeding portion 8. Furthermore, the second detection member 272 is configured as a detection piece installed on the transport guide member 206 arranged between the pickup roller 230 and the paper feeding roller 241. By having the first detection member 271 detect the second detection member 272 due to the movement of the transport guide member 206 accompanying the raising of the rotating board 201, the thus-configured upper limit position detection device 270 is capable of detecting that the rotating board 201 is positioned in the aforementioned standard upper limit position. Due to this detection, the main control portion 54 is configured to stop operation of the elevation drive portion 260 and stop the raising of the rotating board 201. It should be noted that the main control portion 54 is configured to, when there becomes fewer papers P on the rotating board 201 and the detection of the first detection member 271 by the second detection member 272 is cleared by the transport guide member 206 moving downward, operate the elevation drive portion 260 of the elevating device 280 so that the rotating board 201 is raised to a position where the first and second detection member 271 and 272 are put into a detection state.

Description of Characteristic Aspects of Embodiments of the Present Invention

The paper feeding device 200 is further provided with central bending mechanism (one example of a central bending section) 210. The central bending mechanism 210 is configured to upwardly raise a central area P2 of the papers P stacked on the rotating board 201 in the paper transport direction of the papers P. In this paper feeding device 200, the central area P2 of the papers P stacked in the rotating board 201 can be upwardly raised by the central bending mechanism 210 (see FIG. 6C, which is to be described later). In this way, even if the papers P are curled for example, the curled state of the papers P can be effectively mitigated. Accordingly, it becomes possible to reliably prevent paper feeding problems such as paper feeding delays and jamming or the like caused by curling, even for curled papers P.

In the present embodiment, the central bending mechanism 210 is provided with a cam shaped cam member 211, a rotation shaft Q3 that is arranged along a direction orthogonal to the paper transport direction X and that supports the cam member 211, and a rotational mechanism 212 that causes the cam member 211 to rotate on the rotation shaft Q3. By causing the cam member 211 to rotate accompanying rotation of the rotation shaft Q3 due to the rotational mechanism 212, the central area P2 of the papers P stacked in the rotating board 201 can be upwardly raised. In this way, even if the papers P are curled, the curled state of the papers P can be effectively mitigated. For example, even with curled papers P, the papers P can be reliably transported to the nip portion γ between the paper feeding roller 241 and the separation roller 242.

In the present embodiment, the paper feeding device 200 is further provided with a central bending drive portion 213 that serves as a central bending drive section for driving the central bending mechanism 210. The central bending drive portion 213 here is configured as an actuator for rotational driving such as a drive motor, and causes the cam member 211 to rotate by rotationally driving the rotational mechanism 212. By causing the cam member 211 to rotate on the rotation shaft Q3 by rotationally driving the rotational mechanism 212 by the central bending drive portion 213, the central bending mechanism 210 is capable of upwardly raising the central area P2 of the papers P stacked in the rotating board 201.

Furthermore, the paper feeding device 200 is further provided with a curl detection device 215 that serves as a curl detection section for detecting a state of curling of the papers P. And the main control portion 54 is configured (see FIG. 3) to function as a curl determination section 54*a*, which determines whether or not the papers P are curled based on the state of curling detected by the curl detection device 215, and a raising drive section 54*b*, which drives the central bending drive portion 213 when it has been determined by the curl determination section 54*a* that the papers P are curled. It should be noted that the central bending mechanism 210 here includes a cam position detection device 214 that detects a predetermined rotation position (home position) of the cam member 211.

In the case where it has been determined that the papers P are curled based on a state of curling detected by the curl detection device 215, the main control portion 54 is configured to give instruction to the central bending drive portion 213 such that by causing the cam member 211 to rotate on the rotation shaft Q3 by the rotational driving of the rotational mechanism 212 in accordance with the central bending drive portion 213, the central area P2 of the papers P stacked in the rotating board 201 is upwardly raised. With the thus-configured paper feeding device 200, in the case where it has been determined that the papers P are curled based on a state of curling detected by the curl detection device 215 even when initially the papers P are in a regular (not curled) state, then the papers P curl due to subsequent changes in the ambient environment conditions or the like, the central area P2 of the papers P stacked in the rotating board 201 can be automatically raised upwardly by the cam member 211. In this way, even without the user being aware of the state of curling of the papers P, paper feeding problems caused by curling can be reliably prevented.

The cam member 211 is configured such that a distance from its rotational center to an outer circumference during one rotation becomes gradually shorter for a first half of its rotation, and becomes gradually longer for the remaining half of its rotation. Here, there are multiple cam members 211 (here, four). These multiple cam members 211 are arranged along the axial direction of the rotation shaft Q3 extending across a region corresponding to at least the papers P that are stacked. Furthermore, openings 201*c* are provided in the rotating board 201 that allow each of the cam members 211 to protrude upward from an upper surface 201*d* of the rotating board 201. Multiple openings 201*c* are provided at positions corresponding to the multiple cam members 211 of the rotating board 201. And the cam members 211 are provided so as to move to a position of the upper surface 201*d* of the rotating board 201 or a position retracted below the upper surface 201*d* (hereinafter referred to as a retracted position) while rotating until at most 180 degrees from a position at which they most protrude from the upper surface 201*d* of the rotating board 201 (hereinafter referred to as most protruding position). Furthermore, here, an opening 831*c*' is provided at the bottom panel 831*c* of the housing container 831 so that no contact is made with the cam members 211. It should be noted that a single cam member 211 may be provided extending in the axial direction of the rotation shaft Q3.

The rotational mechanism 212 is configured as a drive transmission mechanism that transmits the rotational drive of the central bending drive portion 213 to the rotation shaft Q3 provided for the cam members 211.

The rotational mechanism 212 includes a first coupled gear 212*a* as a first coupled member to which the driving force from a movable portion 213*a* of the central bending drive portion 213 is transmitted, a second coupled gear 212*b* as a second coupled member that is coupled to the rotation shaft Q3, and a third coupled gear 212*c* and a fourth coupled gear 212*d* as third coupled members that transmit drive from the first coupled gear 212*a* to the second coupled gear 212*b*. It should be noted that the third coupled member may be an endless belt or a chain. In this case, the first coupled member and the second coupled member can be achieved as a pulley or a sprocket.

The first coupled gear 212*a* is coupled to a rotation shaft Q4 that is coupled to the movable portion 213*a* of the central bending drive portion 213. Here, one of the two rotation shafts Q1 that support the rotating board 201 to be readily rotatable also serves as the rotation shaft Q4. Furthermore, the first coupled gear 212*a* is configured as a circular arc shaped rack gear. It should be noted that an opening 831*c*" is provided at the bottom panel 831*c* of the housing container 831 so that no contact is made with the first coupled gear 212*a*.

The one rotation shaft Q1 (Q4) is supported to readily rotate on its axis at the one side panel 831*a* of the side panels 831*a* and 831*b* of the housing container 831. Furthermore, the other rotation shaft Q1 has a protruding portion Q1*a* that protrudes outwardly from the side panel 831*a* on one side of the housing container 831. That is, a pass-through hole 831*a*" that passes through in the direction Y orthogonal to the paper transport direction X is arranged on the side panel 831*a* on one side of the housing container 831. And the rotation shaft Q1 inserts into the pass-through hole 831*a*" to readily rotate on it axis. In this manner, the rotation shaft Q1 is supported to readily rotate on its axis at the side panel 831*a* on one side.

Furthermore, an engaging portion Q1*b* that engages with the movable portion 213*a* of the central bending drive portion 213 is securely connected to the protruding portion Q1*a* of the rotation shaft Q1. It should be noted that at least one of the engaging portions Q1*b* of the rotation shaft Q1 and the movable portion 213*a* of the central bending drive portion 213 readily moves along the rotation shaft Q1 and applied with a biasing force to the other side. And when mounting or after mounting the engaging portion Q1*b* of the rotation shaft Q1 and the movable portion 213*a* of the central bending drive portion 213 to the paper feeding portion 8 of the paper feeding tray 83, by rotating the movable portion 213*a* with the engaging portion Q1*b* and the movable portion 213*a* engaging with each other in a concavo-convex manner, the engaging portion Q1*b* rotates accompanying rotation of the movable portion 213*a*.

On the other hand, the rotation shaft Q3 is arranged between the rotating board 201 and the bottom panel 831*c* of the housing container 831 along the direction Y orthogonal to the paper transport direction X so as to be positioned at the central area P2 of the papers P stacked in the rotating board 201. The end portions of the rotation shaft Q3 are supported to readily rotate on their axes at the two restraining members 833*a* and 833*b* of the housing container 831.

In the rotational mechanism 212, the second coupled gear 212*b* is coupled to the rotation shaft Q3 that is provided with the cam members 211. Here, the second coupled gear 212*b* is coupled to an end portion Q3*a* of one of the rotation shaft Q3 protruding outward from the restraining member 833*a* of one side of the two restraining members 833*a* and 833*b*.

The third and fourth coupled gears 212*c* and 212*d* intermesh, while the third coupled gear 212*c* meshes with the first coupled gear 212*a* and the fourth coupled gear 212*d* meshes with the second coupled gear 212*b*. Here, the third and fourth coupled gears 212*c* and 212*d* are supported to readily rotate on their axes at support shafts Q5 and Q6 respectively, which are supported on the restraining member 833*a* on one side. Due to this, the third and fourth coupled gears 212*c* and 212*d* are capable of transmitting the rotational driving force of the central bending drive portion 213 from the first coupled gear 212*a* coupled to the rotation shaft Q1 to the cam members 211 via the rotation shaft Q3 coupled to the second coupled gear 212*b*.

It should be noted that when engaging portion Q1*b* of the rotation shaft Q1 and the movable portion 213*a* of the central bending drive portion 213 are not engaged (that is, when the paper feeding tray 83 is not mounted to the paper feeding portion 8), the first coupled gear (here, a circular arc shaped rack gear) 212*a* becomes positioned at a predetermined initial position due to its own weight. At this time, the cam members 211 are configured to become positioned at the predetermined home position (here, the aforementioned retracted position).

The cam position detection device 214 is provided with a first detection member 214*a*, which is secured in a predetermined position, and a second detection member 214*b*, which is installed at a member of the rotational mechanism 212 that rotates due to the driving of the central bending drive portion 213 (here, the first coupled gear 212*a*). The first and second detection members 214*a* and 214*b* are put into a detection state by movement of the second detection member 214*b* accompanying the driving of the elevation drive portion 213 (here, the rotation of the first coupled gear 212*a*), thereby making the cam position detection device 214 capable of detecting that the cam members 211 are positioned at the home position (here, the aforementioned retracted position).

The first detection member 214*a* is configured as a photosensor secured at a predetermined position on the paper feeding tray 83. Furthermore, the second detection member 214*b* is configured as a detection piece arranged at the first coupled gear 212*a*. By having the first detection member 214*a* detect the second detection member 214*b* due to the rotation of the first coupled gear 212*a*, the thus-configured cam position detection device 214 is capable of detecting that the cam members 211 are positioned in the aforementioned home position. With this detection, in the case where it is determined that the papers P are curled based on the detection result of the curl detection device 215, the main control portion 54 controls a rotation angle of the first coupled gear 212*a* from the home position (see the chain line in FIG. 5B) using as a reference the home position of the cam members 211 according to the cam position detection device 214, thereby rotating the cam members 211 at most 180 degrees such that they protrude (for example, so that they are positioned in the aforementioned most protruding position). It should be noted that the main control portion 54 may also be configured to control the rotation angle of the first coupled gear 212*a* from the home position based on the detection result of the curl detection device 215, thereby causing the cam members 211 to be positioned in a desired rotation position (that is, so as to be capable of adjusting the amount of protrusion from the upper surface 201*d* of the rotating board 201).

In the present embodiment, the curl detection device 215 is configured mainly to detect the state of curling of the papers P that have curled such that both edge portions P1 and P3 have become gradually higher compared to the central area P2 in the paper transport direction X. The curl detection device 215 here is configured as a contact or a proximity sensor, and is capable of detecting whether or not a portion of the paper P curled has contacted or approached to a detection portion 215*a* until a predetermined close position.

As shown in FIG. 4, the curl detection device 215 is provided on the transport guide member 206 between the pickup roller 230 and the paper feeding roller 241, and is configured to detect a state of curling of the paper P pulled out from the rotating board 201 by the pickup roller 230.

Paper Feeding Device Operation

Figure 6A:
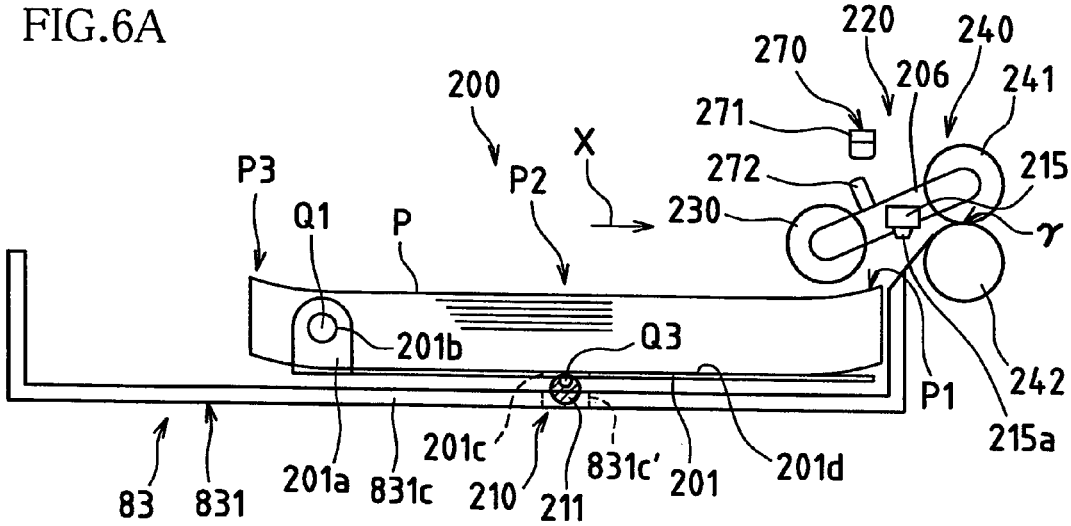
FIG. 6A is a diagram for describing an operation of the paper feeding device according to the present embodiment, and is a perspective view of a state in which curled papers are lowered within the paper feeding tray as viewed from the front.
Figure 6B:
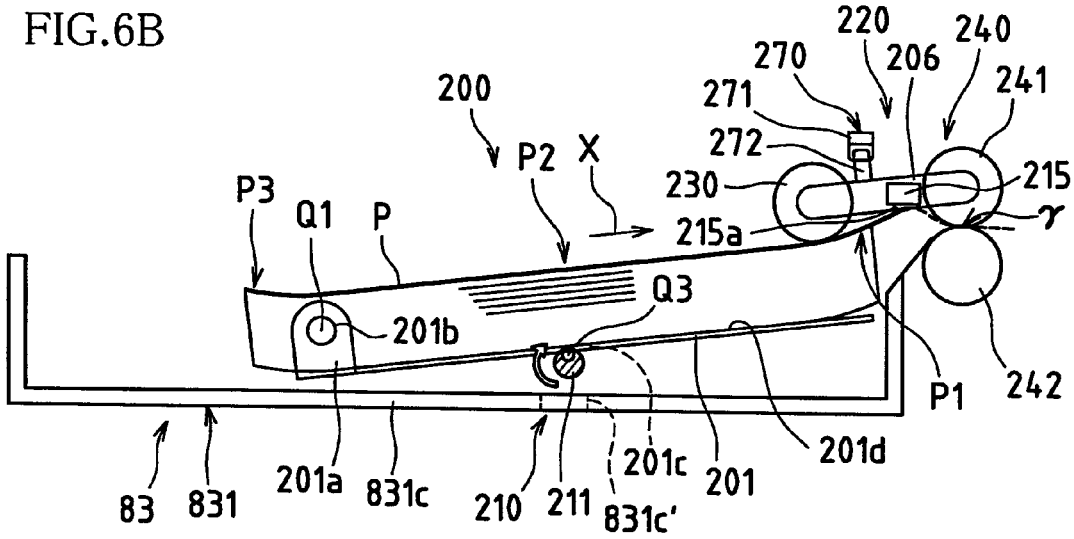
FIG. 6B is a diagram for describing an operation of the paper feeding device according to the present embodiment, and is a perspective view as viewed from the front of a state in which curled papers are raised within the paper feeding tray and the cam member is not protruding from the upper surface of the rotating board.
Figure 6C:
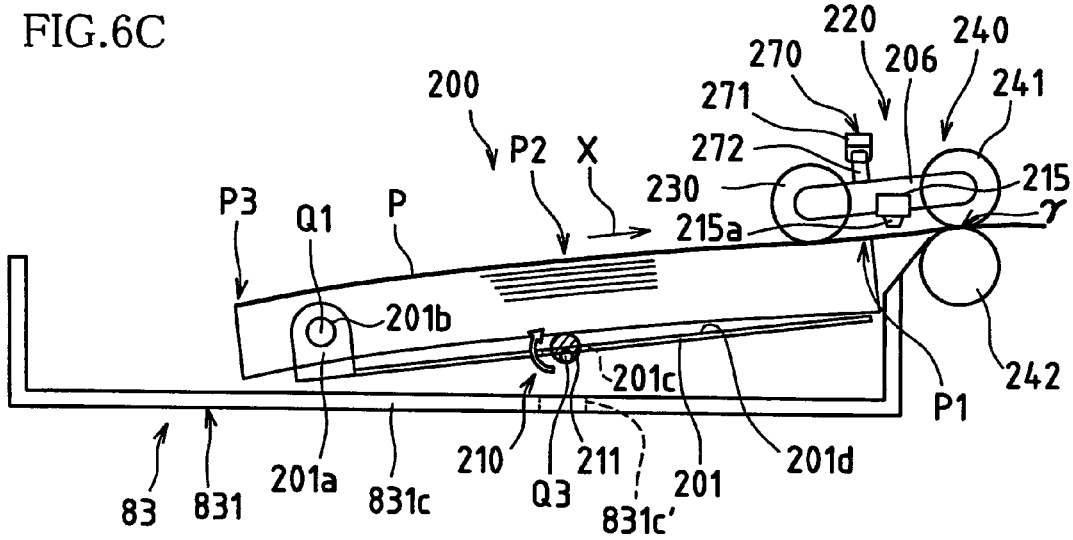
FIG. 6C is a diagram for describing an operation of the paper feeding device according to the present embodiment, and is a perspective view as viewed from the front of a state in which curled papers are raised within the paper feeding tray and the cam member is protruding upward from the upper surface of the rotating board.

FIG. 6 is a diagram for describing operation of the paper feeding device 200 according to the present invention. FIG. 6A is a perspective view of a state in which curled papers P are lowered within the paper feeding tray 83 as viewed from the front. FIG. 6B is a perspective view as viewed from the front of a state in which curled papers P are being raised within the paper feeding tray 83, being a state in which the cam members 211 are not protruding from the upper surface 201*d* of the rotating board 201 (a state positioned at the aforementioned retracted position). FIG. 6C is a perspective view as viewed from the front of a state in which curled papers P are being raised, being a state in which the cam members 211 are protruding upward from the upper surface 201*d* of the rotating board 201 (here, a state in which they are positioned at the aforementioned most protruding position). It should be noted that in FIG. 6, the elevating mechanism 250 and the first restraining member 832 are omitted from the diagrams. Furthermore, the dashed line in FIG. 6B shows a transport trajectory of the paper P leading edge.

In the above-described paper feeding device 200, when a job request is preformed at the image forming apparatus 1A, the rotating board 201 is caused to rotate by the elevation drive portion 260 from the state shown in FIG. 6A so as to approach the pickup roller 230, and when the papers P on the rotating board 201 are raised, the papers P contact the pickup roller 230, and when the papers P are further raised, the first detection member 271 detects the second detection member 272 as shown in FIG. 6B, and the raising of the papers P stops. Then, the pickup roller 230 feeds out the paper P from the rotating board 201 to the nip portion γ between the paper feeding roller 241 and the separation roller 242, and the sheets P are fed sheet by sheet.

At this time, for example under environment conditions of a low temperature and low humidity (10° C., 20% RH) or a high temperature and high humidity (30° C., 85% RH), the papers P tend to curl easily, in particular in the case of papers having a certain thickness such as where the basis weight (grammage) is 100 g/m$^2$ or greater as for firm cardboards and glossy papers or the like, when the papers P in a state of curling is fed while in contact with the transport guide member 206 as shown in FIG. 6B, paper feeding problems may occur due to poor transport force due to frictional load at the contact portion between the paper P and the transport guide member 206, and an increase in the insertion angle to the nip portion γ between the paper feeding roller 241 and the separation roller 242. It should be noted that a force applied to the papers P during pickup is originally set to a low transport force (for example, 1.961 N to 3.432 N (200 gf to 350 gf) in consideration of preventing double feeding of the papers P, and there is a tendency for paper feeding problems caused by curling to become more prevalent due to poor transport force due to friction.

In regard to this point, in the paper feeding device 200 according an embodiment of the present invention, by rotationally driving the movable portion 213*a* of the central bending drive portion 213 by an instruction signal being sent from a manually operated operation section or from the curl detection device 215 to main control portion 54 for the central bending mechanism 210 in which the cam members 211 are in the aforementioned retracted state, the engaging portion Q1*b* engaged to the movable portion 213*a* is caused to rotate, which causes the rotation shafts Q1 to rotate. When this happens, the rotational force of the rotation shafts Q1 are transmitted to the rotation shaft Q3 via the rotational mechanism 212 (here, the first to fourth coupled gears 212*a* to 212*d*), and due to this, the cam members 211 rotate and become positioned in the aforementioned most protruding position as shown in FIG. 6C. At this time, the main control portion 54 drives the central bending drive portion 213 to move from the retracted position to the most protruding position.

With the paper feeding device according to the embodiment of the present invention, the central area P2 of the papers P stacked in the rotating board 201 is upwardly raised by the cam members 211, which protrude upward from the upper surface 201*d* of the rotating board 201, and therefore the state of curling is mitigated and the papers P can be reliably transported to the nip portion γ between the paper feeding roller 241 and the separation roller 242.

Further still, in the case where a state of curling has been detected by the curl detection device 215 and the main control portion 54 has determined that the papers P are curled, the central area P2 of the papers P stacked in the rotating board 201 can be automatically raised upwardly by driving the central bending drive portion 213 that drives the central bending mechanism 210 so as to rotate the cam members 211 of the central bending mechanism 210 via the rotational mechanism 212 by a predetermined rotation angle (for example, 180 degrees) from the retracted position such that the cam members 211 protrude by a predetermined amount from the upper surface 201*d* of the rotating board 201. In this way, even if the user does not confirm the state of curling of the papers P and manually operate the central bending mechanism 210 prior to executing a job, the papers P can be reliably transported to the nip portion γ between the paper feeding roller 241 and the separation roller 242.

Then, at the completion of the job, the main control portion 54 again drives the central bending drive portion 213 to operate the central bending mechanism 210 (here, to rotate the cam members 211 by 180 degrees), thereby enabling the cam members 211 to be returned to the initial state (home position). It should be noted that the configuration for returning the cam members 211 to the initial state is not limited to this configuration, and for example it is possible to leave the cam members 211 in the protruding state and when the engagement of the movable portion 213*a* of the drive portion 213 and the engaging portion Q1*b* of the rotation shaft Q1 (the coupling for linking to the main unit) is released as a result of pulling out the paper feeding tray 83 from the paper feeding portion 8, the first coupled gear (here, the circular arc shaped rack gear) 212*a* returns to the predetermined initial position due to its own weight, thereby returning the cam members 211 to their initial positions.

Furthermore, in the case where a state of curling of the paper P has been detected by the curl detection device 215, the main control portion 54 may allow the detected paper P to continue being transported as it is, then after the transport of this paper P, the central bending mechanism 210 is caused to operate before the commencement of supplying the next paper P to be supplied.

Furthermore, in the present embodiment, the main control portion 54 causes the central bending mechanism 210 to operate with timing by which the state of curling of the paper P has been detected by the curl detection device 215, thereby carrying out mitigation of the state of curling as shown in FIG. 6C, but there is no limitation to this, and this may be carried out in the case where a paper feeding problem has occurred.

Furthermore, the curl detection device 215 is used in the present embodiment, but instead of this it is possible to provide a paper transport detection section such as a paper detection sensor such that in the case where a transport timing of the papers is detected by the paper transport detection section and a determination has been made that the detected timing is delayed from a predetermined standard timing, the main control portion 54 determines that the delay is an influence of an increased transport load due to paper in a curled state, and causes the central bending mechanism 210 to operate. For example, the paper transport detection section can be provided near the nip portion γ between the paper feeding roller 241 and the separation roller 242.

Furthermore, in the present embodiment, components including the cam members 211 are used as the central bending mechanism, but components including the guide member may also be used.

Figure 7:
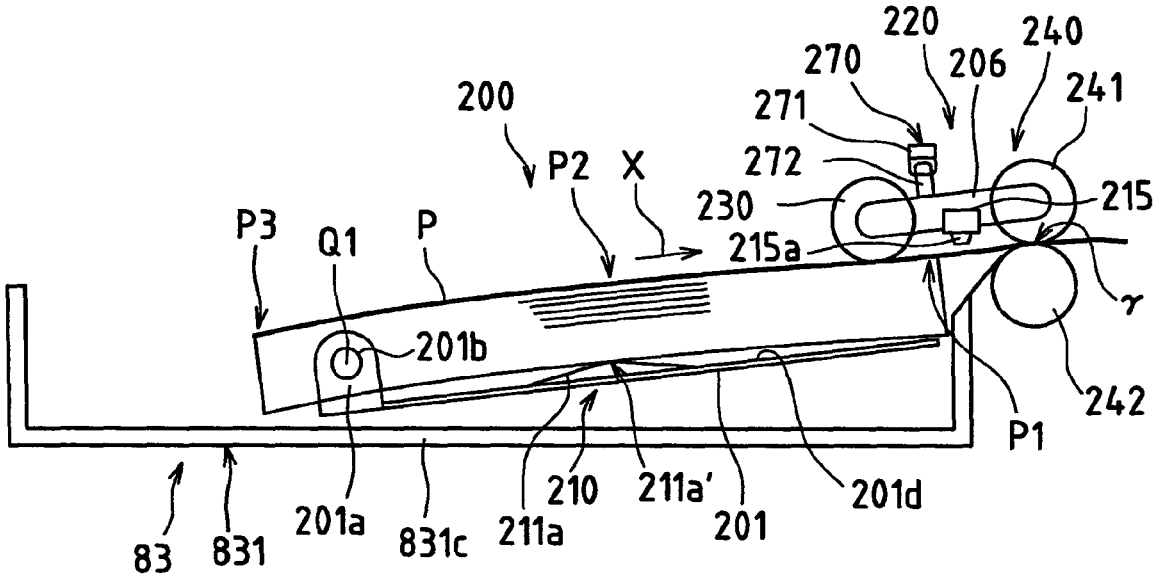
FIG. 7 is a diagram for describing one example of a central bending mechanism provided with a guide member.
Figure 8A:
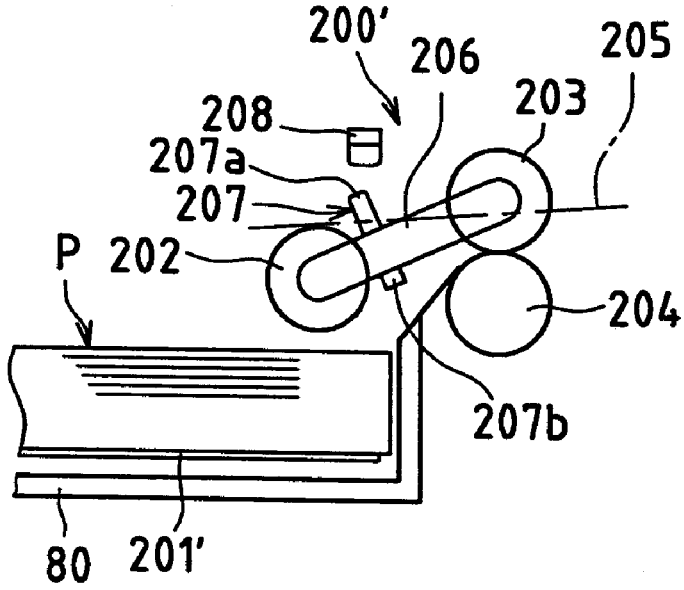
FIG.8A Prior Art
FIG. 8A is a schematic view for describing a paper feeding device described in patent document 3 and shows a state in which sheets, which are not curled, have been lowered within a sheet housing portion.
Figure 8B:
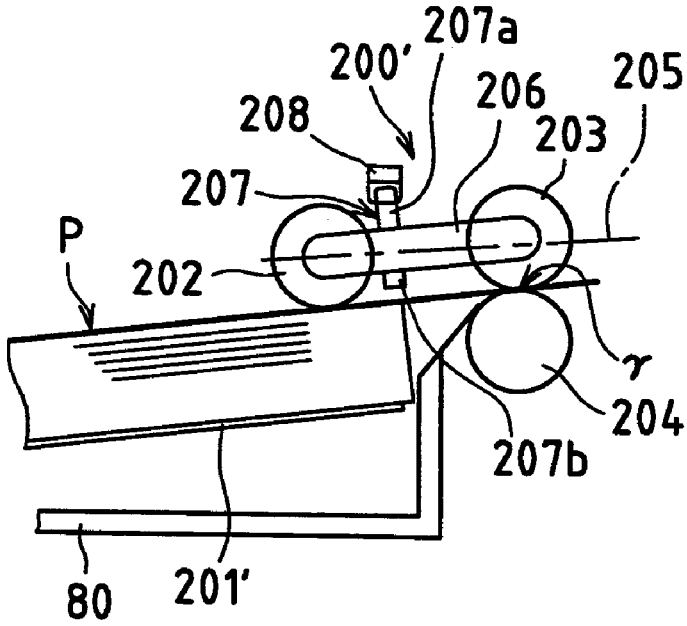
FIG.8B Prior Art
FIG. 8B is a schematic view for describing a paper feeding device described in patent document 3 and shows a state in which the uncurled sheets are being transported after being raised in the sheet housing portion.
Figure 9A:
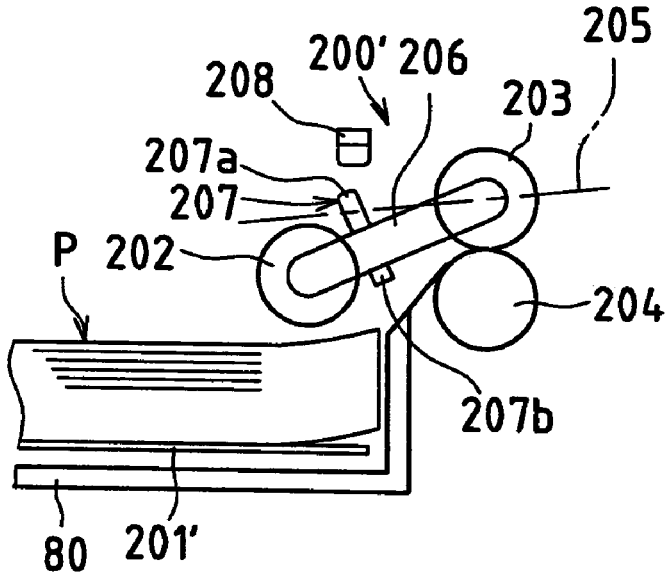
FIG.9A Prior Art
FIG. 9A is a schematic view for describing a paper feeding device described in patent document 3 and shows a state in which sheets, which have curled, have been lowered within a sheet housing portion.
Figure 9B:
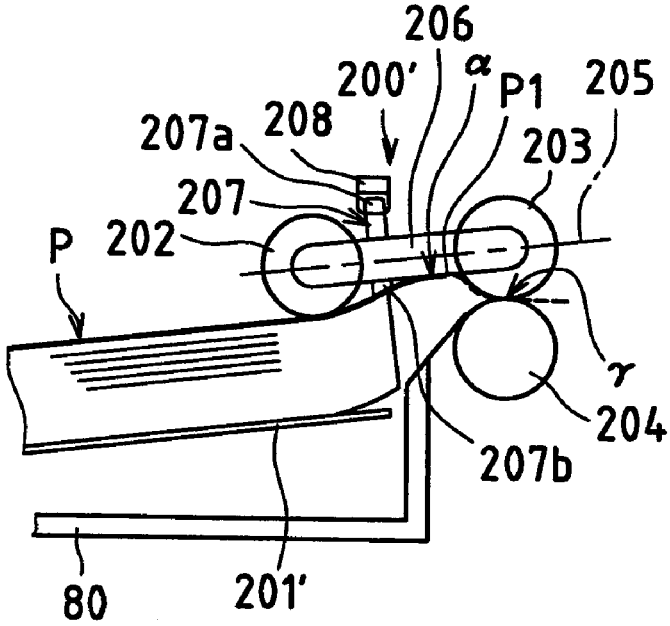
FIG.9B Prior Art
FIG. 9B is a schematic view for describing a paper feeding device described in patent document 3 and shows a state in which the curled sheets are being transported after being raised in the sheet housing portion.

FIG. 7 is a diagram for describing one example of a central bending mechanism 210 provided with a guide member 211*a*. It should be noted that here description is given using an example of a case in which the rotating board 201 is used as the loading member. FIG. 7 shows a state in which the curled papers P are being raised in the paper feeding tray 83.

As shown in FIG. 7, the guide member 211*a* is provided on the rotating board 201, and the papers P are stacked onto the guide member 211*a*.

A central bending guide plate, which has a half-folded structure using a portion 211*a*' corresponding to the central area P2 of the papers P stacked in the rotating board 201 as a reference, can be given as an example of the guide member 211*a*. The central bending guide member 211*a* is configured such that its edges in the paper transport direction X slide and move in contact with the rotating board 201 so that a flexing portion 211*a*' is upwardly raised, and in this way it is possible for the central area P2 of the papers P stacked in the rotating board 201 to be upwardly raised. In this case, the guide member 211*a* can be raised upwardly by an appropriate elevation section. It should be noted that it may also be raised upwardly by the foregoing cam member.

The paper feeding device 200 according to the embodiment of the present invention can be applied to any form of paper housing portion as long as it is provided with a loading member in which paper is stacked, for example, it may also be applied to the large capacity cassette 81 and the manual feeding tray 82 provided in the image forming apparatus 1A according to the present embodiment.

The present invention can be embodied and practiced in other different forms without departing from the spirit and essential characteristics thereof. Therefore, the above-described working examples are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. A paper feeding device, comprising:

a loading member in which a plurality of sheets can be loaded and stacked, a curl detection section for detecting a state of curling of the sheet, a central bending section being disposed at a central area in the loading member in a sheet transport direction and being configured to upwardly raise a central area in the sheet transport direction of the sheets stacked in the loading member, wherein the central bending section is provided with a rotational shaft and a plurality of cam members that protrude through the loading member, the rotational shaft being oriented in a direction orthogonal to sheet transport direction so as to support the plurality of cam members, and the plurality of cam members are positioned along an axial direction of the rotational shaft extending across a region corresponding to at least a portion of the stacked sheets, and a central bending drive section for driving the central bending section, wherein in the case where it has been determined that a sheet is curled based on a state of curling of the sheet detected by the curl detection section, the central area of the sheets stacked in the loading member is upwardly raised due to an operation of the central bending section by the central bending drive section.

2. The paper feeding device according to claim 1, comprising an uptake section for pulling out an uppermost positioned sheet of the sheets stacked in the loading member, and a separation transport section for transporting sheet by sheet the sheets pulled out by the uptake section, wherein the curl detection section is provided between the uptake section and the separation transport section, and detects a state of curling of the sheet pulled out from the loading member by the uptake section.

3. The paper feeding device according to claim 2, wherein the loading member is a rotating board that is rotatable around an axis along a direction orthogonal to a sheet transport direction.

4. The paper feeding device according to claim 3, wherein the members rotate around the axis along the direction orthogonal to a sheet transport direction, and the central area of the sheets stacked in the loading member is upwardly raised by causing the cam member to rotate around the axis.

5. The paper feeding device according to claim 2, wherein the cam members rotate around the axis along the direction orthogonal to a sheet transport direction, and the central area of the sheets stacked in the loading member is upwardly raised by causing the cam member to rotate around the axis.

6. The paper feeding device according to claim 1, wherein the loading member is a rotating board that is rotatable around an axis along a direction orthogonal to a sheet transport direction.

7. The paper feeding device according to claim 6, wherein the members rotate around the axis along the direction orthogonal to a sheet transport direction, and the central area of the sheets stacked in the loading member is upwardly raised by causing the cam member to rotate around the axis.

8. The paper feeding device according to claim 1, wherein the cam members rotate around the axis along the direction orthogonal to a sheet transport direction, and the central area of the sheets stacked in the loading member is upwardly raised by causing the cam member to rotate around the axis.

* * * * *